United States Patent [19]

Schoendube

[11] 4,281,306

[45] Jul. 28, 1981

[54] ELECTRIC BUS BAR ASSEMBLY FOR POLYPHASE DISTRIBUTION TRANSFORMERS

[75] Inventor: Charles W. Schoendube, Hickory, N.C.

[73] Assignee: General Electric Company, Philadelphia, Pa.

[21] Appl. No.: 149,779

[22] Filed: May 14, 1980

[51] Int. Cl.[3] ..... H01F 33/00

[52] U.S. Cl. ..... 336/5; 174/68 B

[58] Field of Search ..... 361/341; 174/68 B, 70 B, 174/138 D; 336/5, 10, 12; 307/13, 17

[56] References Cited

FOREIGN PATENT DOCUMENTS 1028950 5/1953 France ..... 336/5

*Primary Examiner*—Thomas J. Kozma

*Attorney, Agent, or Firm*—William Freedman

[57] ABSTRACT

Bus structure for a polyphase distribution transformer comprises a plurality of bus bars mounted atop the core and coil assembly of the transformer. A common support member for the bus bars has an opening aligned with openings in the bus bars, and a bolt has a shank extending through the aligned openings. The bolt has a head at one side of the bus bars and a nut threaded onto the shank and located at the opposite side of the support member from the bus bars. Tubular spacers of insulating material surround the shank and are respectively located between adjacent bus bars, between the support member and the closest bus bar, and between the bolt head and the most remote bus bar. The nut cooperates with the bolt head when tightened on the threaded shank to clamp the bus bars together and to the support member. A sleeve of insulation surrounds the shank and is positioned within the openings in the bus bars.

7 Claims, 5 Drawing Figures

4
4
67
54
66
50
64
16
65
64
14
45
52
64
12
45
64
42
43
63
40
58
60
41
30

65
64
42
40
58
41
30

68
67
52
69

ELECTRIC BUS BAR ASSEMBLY FOR POLYPHASE DISTRIBUTION TRANSFORMERS

BACKGROUND

This invention relates to an electric bus bar assembly and, more particularly, to a bus bar assembly that is especially adapted for use as the low voltage bus bar assembly of a polyphase distribution transformer.

In certain polyphase distribution transformers, it is conventional to provide low-voltage electric bus bars extending across the top of the core and coil assembly for electrically interconnecting the coils with each other and with the usual terminal bushings for the transformer. These bus bars must be rigidly supported to maintain them in their desired positions despite high displacement forces, e.g., short-circuit produced magnetic forces, and the support means must be compact to conserve the limited available space.

SUMMARY

An object of my invention is to provide a bus-bar supporting and insulating assembly for such service which has a high degree of rigidity and compactness and which is simple, relatively inexpensive, and easy to assemble.

Another object is to provide a bus-bar supporting and insulating assembly of this type which readily lends itself to use with bus bars of many different sizes.

In carrying out my invention in one form, I provide a plurality of horizontally spaced bus bars, each having at its horizontally opposite sides vertically extending surface portions. The bus bars have generally aligned openings extending horizontally therethrough. A common metallic support member for the bus bars has a horizontally extending opening generally aligned with the openings in the bus bars.

The bus bars are fastened to the support member by a metal fastening device having a shank, a head at one end of the shank, and threads at the other end of the shank. The shank extends through the aligned openings in the bus bars and support member, and the head is at the opposite side from the support member of the bus bar most remote from the support member. Tubular spacers of insulating material surround the shank and are respectively located between the adjacent bus bars, between the support member and the closest bus bar, and between the most remote bus bar and the head of the fastening device. Internally-threaded means cooperates with the threaded portion of the shank to provide force-transmitting means between the support member and the fastening device. The internally-threaded means cooperates with the head when relative rotation occurs between the shank and the internally-threaded means to clamp the bus bars together and to the support member. A sleeve of insulating material surrounds the shank and is positioned within the openings in the bus bar for providing an insulating barrier between the bus bars and the shank.

DETAILED DESCRIPTION OF PREFERRED EMBODIMENT

Figure 1:
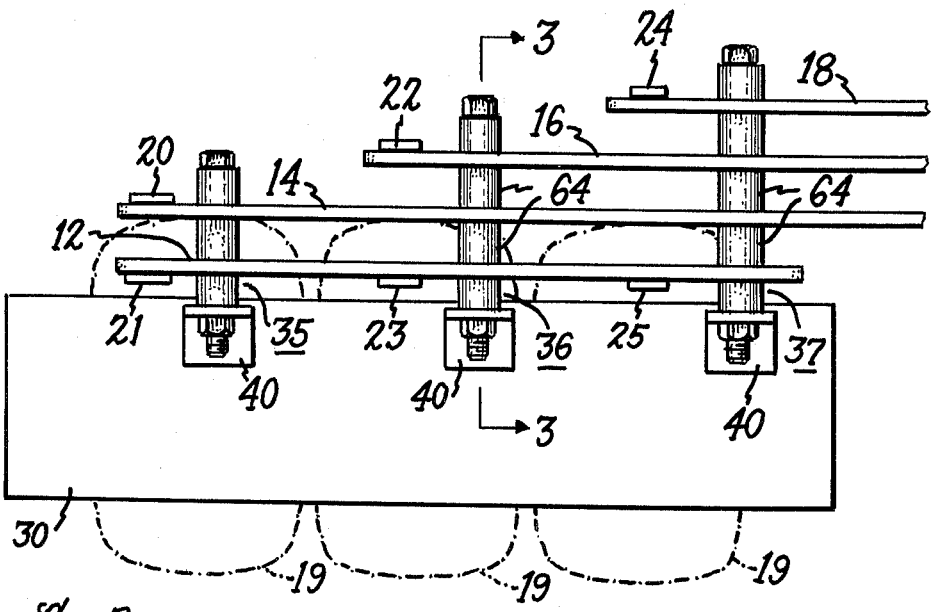
FIG. 1 is a plan view of a three-phase transformer with a bus bar assembly embodying one form of the invention.
Figure 2:
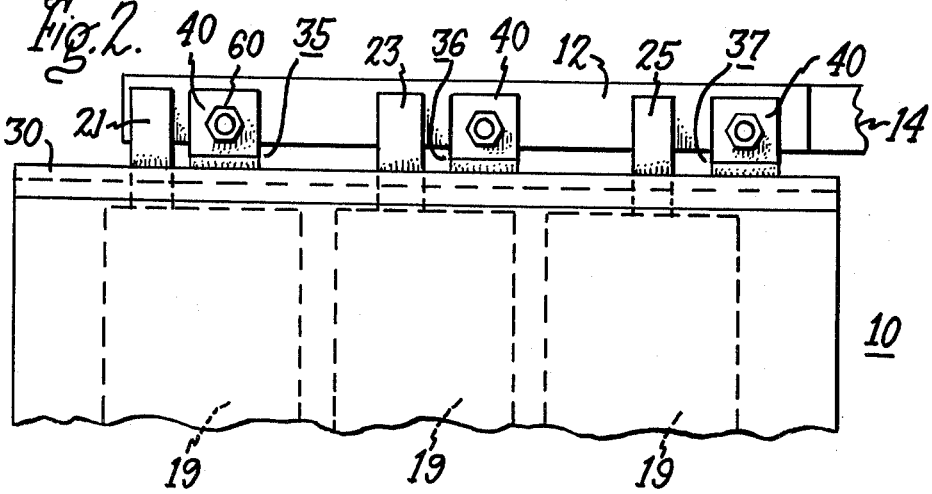
FIG. 2 is a side elevational view of the structure of FIG. 1.

Referring now to FIGS 1 and 2, there is shown a portion of a pad-mounted three-phase distribution transformer comprising a core and coil assembly 10 shown for simplicity in highly schematic form. Located atop the core and coil assembly are a plurality of low voltage bus bars 12, 14, 16, and 18. These bus bars electrically connect the coils 19 of the transformer to each other and to terminal bushings (not shown) located near the right hand end of the bus bars. At predetermined locations along the length of the bus bars there are flexible low voltage leads 20–25 welded to the bus bars and electrically connecting the bus bars to the transformer coils 19 in the assembly 10 in a conventional manner (not shown in detail).

Figures 3, 4, 5:
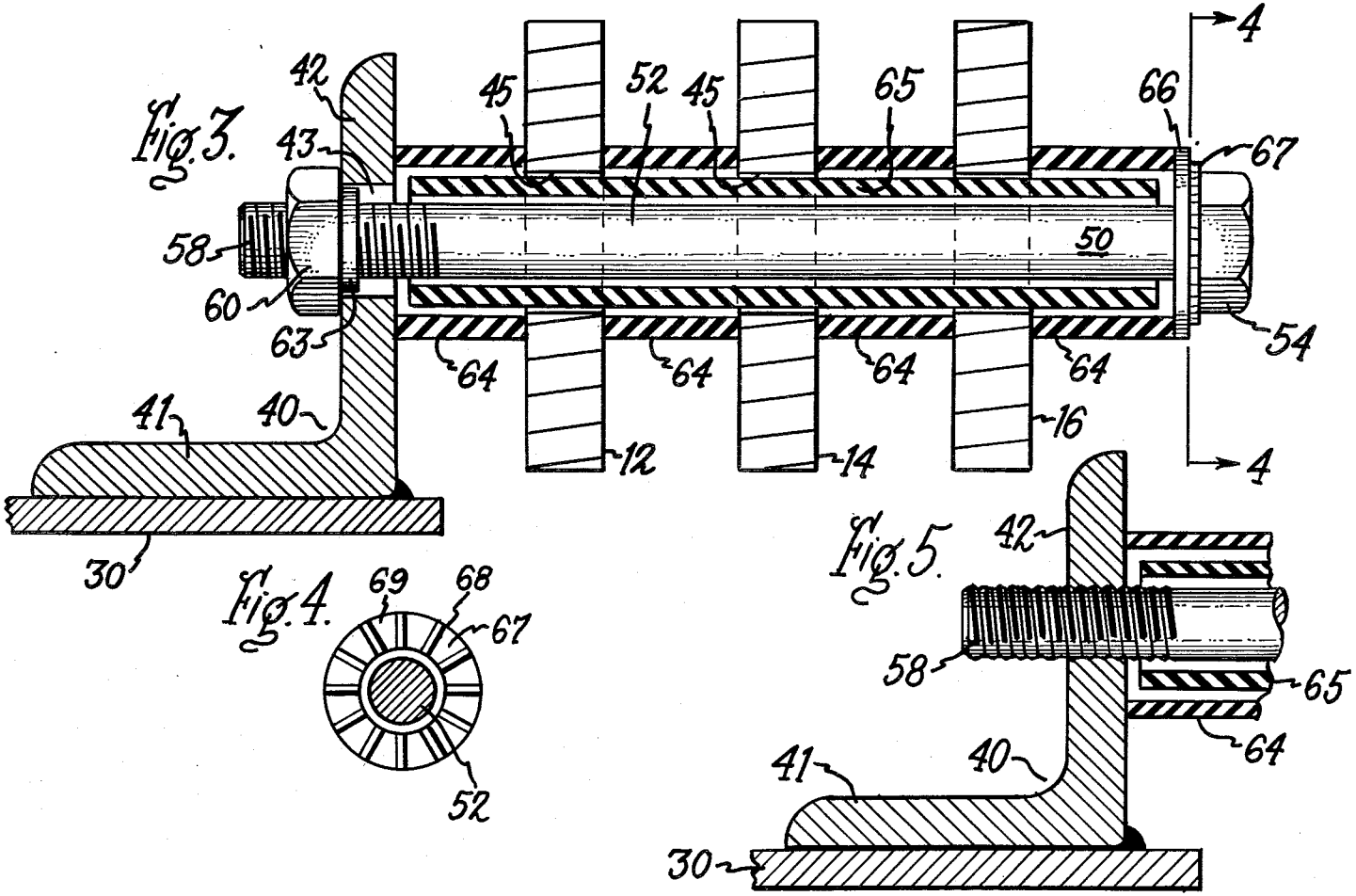
FIG. 3 is a sectional view of the bus bar assembly of FIG. 1 taken along the line 3-3.
FIG. 4 is a sectional view taken along line 4—4 of FIG. 3.
FIG. 5 is a partial view of another embodiment of supporting the bolt of the bus bar assembly.

The illustrated core and coil assembly 10 includes a metal core and coil clamping member 30 at its top, and on this clamping member 30 the bus bars 12, 14, 16 and 18 are supported directly over the projecting coil ends. The supports for the bus bars, which are designated 35, 36 and 37, are located at spaced points along the length of clamping member 30 and are each of similar construction. FIG. 3 is a detailed sectional view of the support 36.

Referring to FIG. 3, support 36 comprises a common metallic support member 40 for the three bus bars 12, 14, and 16. This support membert 40 is a short length of angle iron comprising a horizontal leg 41 welded to the clamping member 30 and a vertical leg 42 having a horizontally-extending opening therein in the form of a drilled or punched hole 43. The bus bars 12, 14, and 16 are horizontally-spaced bars of rectangular cross-section each having at its horizontally-opposed sides vertically-extending flat surface portions. The width dimension of each bus bar extends vertically, and the much smaller thickness dimension extends horizontally. The bus bars have generally aligned openings, or holes, 45 extending horizontally therethrough, and these openings 45 align with the opening 43 in support member 40.

A metal bolt 50, preferably of non-magnetic metal such as bronze or stainless steel to reduce eddy current heating, has a shank portion 52 that extends through the aligned openings 45 and 43. At one end of the shank 52, the bolt 50 has a head 54 which is located at the opposite side of the remote bus bar 16 from the support member 40. At the other end of the shank 52, there is a threaded portion 58, and a nut 60 is threaded onto this threaded portion 58. The nut 60 is located on the opposite side of the support member 40 from the bus bars 12, 14, and 16.

Surrounding the shank portion 52 are four colinearly-disposed tubular spacers 64 of insulating material, preferably a high strength resin reinforced with glass fibres or paper. Two of the tubular spacers 64 are located between adjacent bus bars 12 and 14 and bus bars 14 and 16, respectively. One of the remaining tubular spacers 64 is located between the bolt head 54 and the most remote bus bar 16, and the other remaining tubular spacer 64 is located between the support member 40 and the bus bar 12 closest to the support member 40. Juxtaposed annular washers 66 and 67 transmit force between the bolt head 54 and the outer spacer tube 64. When the nut 60 is tightened on threads 58, it cooperates with the bolt head 54 at the opposite end of the bolt to clamp the bus bars 12, 14, and 16 together and to the support member 40. In effect, the support member 40, the spacers 64 and the bus bars 12, 14, and 16 are sandwiched between the nut 60 and bolt head 54 when the nut 60 is tightened.

The above-described washer 66 is a flat washer with smooth surfaces, but the juxtaposed washer 67 (shown in detail in FIG. 4) has radially extending teeth on its surfaces. The small radially extending passages 69 provided between these teeth 68 afford access between the space located internally of the tubular spacers 64 and the space surrounding the bus structure. These passages 69 allow this space to be evacuated and then filled with oil, when the transformer casing (not shown) that surrounds the illustrated structure is evacuated and then filled with oil.

For centering the shank 52 of bolt 50 centrally of the holes 45 in the bus bars 12, 14, 16, the nut 60 is provided with a projecting shoulder portion 63 that fits snugly into the opening 43 in the support member. When the nut 60 is tightened, this projecting shoulder enters the opening 43, thus centering the shank 52 within hole 43 and preventing it from shifting radially.

For further assuring that the bus bars 12, 14 and 16 will remain electrically isolated from the metal bolt extending therethrough, a tubular sleeve 65 of insulating material is provided around the shank 52 of the bolt. This sleeve extends loosely through the openings 45 in the bus bars and provides an insulating barrier between the bus bars and the shank 52.

It will be apparent that the bus bar supporting arrangement of FIG. 3 is very compact and simple (a) since it has only a single basic support (40) on which all three bus bars are carried, (b) since it has only a single fastening device (bolt 50) for securing all the bus bars together and to the support 40, and (c) since each pair of juxtaposed parts at different potentials are separated simply by a single, simple insulating tube which needs to be only as long as required to assure the necessary electrical isolation between these parts. The assembly has a high degree of rigidity since the bolt 50 solidly clamps all the parts together in compression. The assembly is able to effectively withstand short-circuit stresses since any magnetic forces developed between the bus bars will either load the bolt 50 in tension on the spacers tubes 64 in compression, and these parts are readily capable of withstanding such loadings without damage.

It is to be further noted that, in the preferred embodiment, all of the supports 35, 36 and 37 use identical parts with the exception of the bolts 50 and the surrounding sleeve 65; and even these bolts 50 and surrounding sleeve 65 are the same for the three supports except for differences in length. By using such identical or similar parts, manufacturing and inventory-keeping are simplified and made less expensive.

It is to be further noted that the same components may be used for the bus supporting arrangement even though the bus bars may be changed in size, e.g., made moderately thicker or moderately wider. Despite these changes, the supporting arrangement fits together in the same manner and provides the same electrical creepage distances.

It is also to be noted that the parts of the supports are simple structural forms such as tubes, bolts, and angle irons. There is no need to purchase or manufacture specialized or custom designs, such as supports with slots to fit each bus bar. The spacer tubes 64 are the same for each support and for all of the supports, and this is advantageous because these tubes are simple and inexpensive components and also the components most frequently used in the supports. Although these spacer tubes are shown as having a cylindrical outer periphery, my invention in its broader aspects contemplates the use of spacer tubes with rectangular or other shaped outer peripheries instead of the cylindrical peripheries shown.

For purposes of the present application, such hollow spacers irrespective of the configuration of their outer peripheries are considered to be "tubular". It is to be understood, of course, that the tubular spacers can be of differing lengths if this should be needed to accommodate other bus configurations.

Assembly of a support is a simple matter. More specifically, the spacers 64 are suitably positioned with respect to the bus bars; the tube 65 is inserted through the spacers; the bolt 50 is inserted into tube 65; and the resulting assembly is bolted to the angle iron 40 by applying nut 60. The angle iron 40 had already been suitably located on the clamping plate 30 and welded thereto.

Although I prefer to use a nut (60) for supporting the bolt on the angle iron 40, it is to be understood that my invention in its broader aspects contemplates using an internally-threaded hole in vertical leg 42 of the support 40 into which the threaded portion 58 of the bolt is directly threaded. This modification is shown in FIG. 5

My invention in its broader aspects also comprehends reversing the bolt 50 so that its head 54 is located adjacent the support 40 and its nut at the remote side of the assembly.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. Electric bus structure for a polyphase distribution transformer comprising a core-and-coil assembly, said bus structure comprising:

(a) a plurality of horizontally-spaced bus bars located above the core-and-coil assembly, each bus bar having at its horizontally-opposite sides generally vertically-extending surface portions, said bus bars having generally aligned openings extending horizontally therethrough, (b) a common metallic support member for said bus bars fixed to said core-and-coil assembly and having a horizontally extending opening generally aligning with the openings in said bus bars, (c) a metal fastening device having a shank, a head at one end of the shank, and threads at the other end of the shank, (d) said fastening device being positioned so that said shank extends through said aligned openings in said bus bars and said support member and so that said head is at the opposite side from said support member of the bus bar most remote from the support member, (e) tubular spacers of insulating material surrounding said shank and respectively located between adjacent bus bars, between said support member and the bus bar closest thereto, and between said most remote bus bar and the head of said fastening device, (f) internally-threaded means cooperating with said threaded portion of said shank to provide force-transmitting means between said support member and said fastening device, said internally-threaded means cooperating with said head when relative rotation occurs between said shank and said internally-threaded means to clamp said bus bars together and to said support member, and (g) a sleeve of insulating material surrounding said shank and positioned within the openings in said bus bars for providing an insulating barrier between said bus bars and said shank.

2. The bus structure of claim 1 in which said internally-threaded means comprises a nut threaded onto the threaded portion of said shank and located at the opposite side of said support from said bus bars.

3. The bus structure of claim 2 in which said nut has a portion fitting with little clearance into said opening in said support to block shifting of said bolt in a direction laterally of said shank.

4. Bus structure as defined in claim 2 and further comprising a washer located between said head and the juxtaposed spacer, said washer having a surface with generally radially extending projections thereon, providing passages between said projections affording access to the space surrounded by said tubular spacers to permit evacuation and filling of said space.

5. The bus structure of claim 1 in which said internally threaded means comprises a portion of said support member containing an internally threaded hole into which said threaded shank portion is threaded.

6. Electric bus structure for a polyphase distribution transformer comprising a core-and-coil assembly, said bus structure comprising:

(a) a plurality of horizontally-spaced bus bars located above the core-and-coil assembly, each bus bar having at its horizontally-opposite sides generally vertically-extending surface portions, said bus bars having generally aligned openings extending horizontally therethrough, (b) a common metallic support member for said bus bars fixed to said core-and-coil assembly and having a horizontally extending opening generally aligning with the openings in said bus bars, (c) a metal bolt having a shank, a head at one end of the shank, and threads at the other end of the shank, (d) said bolt being positioned so that said shank extends through said aligned openings in said bus bars and said support member, (e) tubular spacers of insulating material surrounding said shank and respectively located between adjacent bus bars, between said support member and the bus bar closest thereto, and adjacent the bus bar most remote from said support at the outer side of said most remote bus bar, (f) a nut threaded onto the threaded portion of said shank and located at one side of the assembly comprising said support member, said bus bars, and said spacers; the head of said bolt being located at the opposite side of said assembly, said nut and bolt head cooperating when said nut is tightened on said threaded portion to clamp said bus bars together and to said support member, and (g) a sleeve of insulating material surrounding said shank and positioned within the openings in said bus bars for providing an insulating barrier between said bus bars and said shank.

7. The bus structure of claim 6 in which said nut has a portion fitting with little clearance into the opening in said support to block shifting of said bolt laterally of said shank.

* * * * *